US011193197B2

(12) United States Patent
Illing et al.

(10) Patent No.: US 11,193,197 B2
(45) Date of Patent: Dec. 7, 2021

(54) CHEMICAL ACTIVATION OF SELF-PASSIVATING METALS

(71) Applicant: Swagelok Company, Solon, OH (US)

(72) Inventors: Cyprian A. W. Illing, Broomfield, CO (US); Peter C. Williams, Cleveland Heights, OH (US); Christina Semkow, University Heights, OH (US)

(73) Assignee: SWAGELOK COMPANY, Solon, OH (US)

( * ) Notice: Subject to any disclaimer, the term of this patent is extended or adjusted under 35 U.S.C. 154(b) by 184 days.

(21) Appl. No.: 16/433,083

(22) Filed: Jun. 6, 2019

(65) Prior Publication Data

US 2019/0376173 A1 Dec. 12, 2019

Related U.S. Application Data

(60) Provisional application No. 62/792,172, filed on Jan. 14, 2019, provisional application No. 62/683,093, filed on Jun. 11, 2018.

(51) Int. Cl.

| | |
|---|---|
| ***C23C 8/22*** | (2006.01) |
| ***C23C 8/26*** | (2006.01) |
| ***C23C 8/32*** | (2006.01) |
| *C21D 1/06* | (2006.01) |

(52) U.S. Cl.

CPC ..... *C23C 8/22* (2013.01); *C23C 8/26* (2013.01); *C23C 8/32* (2013.01); *C21D 1/06* (2013.01)

(58) Field of Classification Search

CPC .... C23C 8/02; C23C 8/20; C23C 8/22; C23C 8/24; C23C 8/26; C23C 8/32

See application file for complete search history.

(56) References Cited

U.S. PATENT DOCUMENTS

| | | | |
|---|---|---|---|
| 3,232,797 | A | 2/1966 | Bessen |
| 5,556,483 | A | 9/1996 | Tahara et al. |
| 5,593,510 | A | 1/1997 | Tahara et al. |
| 5,792,282 | A | 8/1998 | Tahara et al. |
| 6,093,303 | A | 7/2000 | Williams et al. |
| 6,165,597 | A | 12/2000 | Williams et al. |
| 6,547,888 | B1 | 4/2003 | Williams et al. |
| 8,414,710 | B2 | 4/2013 | Minemura et al. |
| 8,784,576 | B2 | 7/2014 | Somers et al. |
| 8,845,823 | B2 | 9/2014 | Christiansen et al. |
| 10,214,805 | B2 | 2/2019 | Williams et al. |
| 2016/0032442 | A1 | 2/2016 | Williams et al. |
| 2017/0166986 | A1 | 6/2017 | Schiroky |

FOREIGN PATENT DOCUMENTS

| | | |
|---|---|---|
| DE | 4342730 | 6/1995 |
| EP | 516899 | 12/1992 |
| EP | 787817 | 8/1997 |
| JP | 9-071853 | 3/1997 |
| JP | 9-268364 | 10/1997 |
| WO | 2011/009463 | 1/2011 |
| WO | 2016/027042 | 2/2016 |
| WO | 2019/241011 | 12/2019 |

OTHER PUBLICATIONS

Ge et al., "The effect of surface finish on low-temperature acetylene-based carburization of 316L Austenitic Stainless Steel", Metallurgical and Materials Transactions B, vol. 45B, Dec. 2014, pp. 2338-2345.

Stickels, "Gas Carburizing", ASM Handbook, vol. 4, Heat Treating, pp. 312-324, 1991.

Johnson et al., "Chemisorption and thermal decomposition of methylamine on the ruthenium (001) surface", J. Am. Chem. Soc. vol. 114, No. 11, p. 4279-0490, May 1992.

Bond, "The role of carbon deposits in metal-catalysed reactions of hydrocarbons", Applied Catalysis A: General., vol. 149, No. 1, pp. 3-25, Jan. 1997.

Zhu et al., "Graphitic Carbon Nitride: Synthesis, Properties, and Applications in Catalysis", ASC Applied Materials & Interfaces, vol. 6, No. 19, p. 16449-16465, Oct. 2014.

STAG Melissen et al., "DFT Perspective on the Thermochemistry of Carbon Nitride Synthesis", J. of Physical Chemistry C. vol. 120, No. 43, p. 24542-24550, Nov. 2016.

International Search Report from PCT/US2019/035694 dated Aug. 2, 2019.

International Search Report and Written Opinion from PCT/US2020/063284 dated Apr. 13, 2021.

*Primary Examiner* — Jessee R Roe

(74) *Attorney, Agent, or Firm* — Calfee, Halter & Griswold LLP

(57) ABSTRACT

A workpiece made from a self-passivating metal and having one or more surface regions defining a Beilby layer as a result of a previous metal shaping operation is activated for subsequent low temperature gas hardening by exposing the workpiece to the vapors produced by heating a non-polymeric N/C/H compound.

15 Claims, No Drawings

CHEMICAL ACTIVATION OF SELF-PASSIVATING METALS

CROSS-REFERENCE TO RELATED APPLICATION

This application claims priority to U.S. Provisional Patent Application Ser. No. 62/683,093, filed Jun. 11, 2018, as well as to U.S. Provisional Patent Application Ser. No. 62/792,172, filed Jan. 14, 2019. The entire disclosures of both applications are incorporated herein by reference.

BACKGROUND

Conventional Carburization

Conventional (high temperature) carburization is a widely used industrial process for enhancing the surface hardness of shaped metal articles ("case hardening"). In a typical commercial process, the workpiece is contacted with a carbon-containing gas at elevated temperature (e.g., 1,000° C. or more) whereby carbon atoms liberated by decomposition of the gas diffuse into the workpiece's surface. Hardening occurs through the reaction of these diffused carbon atoms with one or more metals in the workpiece thereby forming distinct chemical compounds, i.e., carbides, followed by precipitation of these carbides as discrete, extremely hard, crystalline particles in the metal matrix forming the workpiece's surface. See, Stickels, "Gas Carburizing", pp 312 to 324, Volume 4, *ASM Handbook,* © 1991, ASM International.

Stainless steel is corrosion-resistant because the chromium oxide surface coating that immediately forms when the steel is exposed to air is impervious to the transmission of water vapor, oxygen and other chemicals. Nickel-based, cobalt-based, manganese-based and other alloys containing significant amounts of chromium, typically 10 wt. % or more, also form these impervious chromium oxide coatings. Titanium based alloys exhibit a similar phenomenon in that they also immediately form titanium dioxide coatings when exposed to air which are also impervious to the transmission of water vapor, oxygen and other chemicals.

These alloys are said to be self-passivating, not only because they form oxide surface coatings immediately upon exposure to air but also because these oxide coatings are impervious to the transmission of water vapor, oxygen and other chemicals. These coatings are fundamentally different from the iron oxide coatings that form when iron and other low alloy steels are exposed to air, e.g., rust. This is because these iron oxide coatings are not impervious to the transmission of water vapor, oxygen and other chemicals, as can be appreciated by the fact that these alloys can be completely consumed by rust if not suitably protected.

When stainless steel is traditionally carburized, the chromium content of the steel is locally depleted through the formation of the carbide precipitates responsible for surface hardening. As a result, there is insufficient chromium in near-surface areas immediately surrounding the chromium carbide precipitates to form the protective chromium oxide on the surface. Since the corrosion resistance of the steel is compromised, stainless steel is rarely case-hardened by conventional (high temperature) carburization,

Low Temperature Carburization

In the mid 1980's, a technique for case hardening stainless steel was developed in which the workpiece is contacted with a carbon-containing gas at low temperature, typically below ~500° C. At these temperatures, and provided that carburization does not last too long, carbon atoms liberated by decomposition of the gas diffuse into the workpiece surfaces, typically to a depth of 20-50 μm, without formation of carbide precipitates. Nonetheless, an extraordinarily hard case (surface layer) is obtained. Because carbide precipitates are not produced, the corrosion resistance of the steel is unimpaired, even improved. This technique, which is referred to a "low temperature carburization," is described in a number of publications including U.S. Pat. Nos. 5,556,483, 5,593,510, 5,792,282, 6,165,597, EPO 0787817, Japan 9-14019 (Kokai 9-268364) and Japan 9-71853 (Kokai 9-71853).

Nitriding and Carbonitriding

In addition to carburization, nitriding and carbonitriding can be used to surface harden various metals. Nitriding works in essentially the same way as carburization except that, rather than using a carbon-containing gas which decomposes to yield carbon atoms for surface hardening, nitriding uses a nitrogen containing gas which decomposes to yield nitrogen atoms for surface hardening.

In the same way as carburization, however, if nitriding is accomplished at higher temperatures and without rapid quenching, hardening occurs through the formation and precipitation of discrete compounds of the diffusing atoms, i.e., nitrides. On the other hand, if nitriding is accomplished at lower temperatures without plasma, hardening occurs without formation of these precipitates through the stress placed on the crystal lattice of the metal by the nitrogen atoms which have diffused into this lattice. As in the case of carburization, stainless steels are not normally nitrided by conventional (high temperature) or plasma nitriding, because the inherent corrosion resistance of the steel is lost when the chromium in the steel reacts with the diffusion nitrogen atoms to cause nitrides to form.

In carbonitriding, the workpiece is exposed to both nitrogen and carbon-containing gases, whereby both nitrogen atoms and carbon atoms diffuse into the workpiece for surface hardening. In the same way as carburization and nitriding, carbonitriding can be accomplished at higher temperatures, in which case hardening occurs through the formation of nitride and carbide precipitates, or at lower temperatures in which case hardening occurs through the sharply localized stress fields that are created in the crystal lattice of the metal by the interstitially dissolved nitrogen and carbon atoms that have diffused into this lattice. For convenience, all three of these processes, i.e., carburization, nitriding and carbonitriding, are collectively referred to in this disclosure as "low temperature surface hardening" or "low temperature surface hardening processes."

Activation

Because the temperatures involved in low temperature surface hardening are so low, carbon and/or nitrogen atoms will not penetrate the chromium oxide protective coating of stainless steel. Therefore, low temperature surface hardening of these metals is normally preceded by an activation ("depassivation") step in which the workpiece is contacted with a halogen containing gas such as HF, HCl, $NF_3$, $F_2$ or $Cl_2$ at elevated temperature, e.g., 200 to 400° C., to make the steel's protective oxide coating transparent to the passage of carbon and/or nitrogen atoms.

WO 2006/136166 (U.S. Pat. No. 8,784,576) to Somers et al., the disclosure of which is incorporated herein by reference, describes a modified process for low temperature carburization of stainless steel in which acetylene is used as the active ingredient in the carburizing gas, i.e., as the source compound for supplying the carbon atoms for the carburization process. As indicated there, a separate activation step with a halogen containing gas is unnecessary, because the acetylene source compound is reactive enough to depassivate the steel as well. Thus, the carburization technology of this disclosure can be regarded as self-activating.

WO 2011/009463 (U.S. Pat. No. 8,845,823) to Christiansen et al., the disclosure of which is also incorporated herein by reference, describes a similar modified process for carbonitriding stainless steel in which an oxygen-containing "N/C compound" such as urea, formamide and the like is used as the source compound for supplying the nitrogen and carbon atoms needed for the carbonitriding process. The technology of this disclosure can also be considered to be self-activating, because a separate activation step with a halogen containing gas is also said to be unnecessary.

Surface Preparation and the Beilby Layer

Low temperature surface hardening is often done on workpieces with complex shape. To develop these shapes, some type of metal shaping operation is usually required such as a cutting step (e.g., sawing scraping, machining) and/or a wrought processing step (e.g., forging, drawing, bending, etc.). As a result of these steps, structural defects in the crystal structure as well as contaminants such as lubricants, moisture, oxygen, etc., are often introduced into the near-surface region of the metal. As a result, in most workpieces of complex shape, there is normally created a highly defective surface layer having a plastic deformation-induced extra-fine grain structure and significant levels of contamination. This layer, which can be up to 2.5 μm thick and which is known as the Beilby layer, forms immediately below the protective, coherent chromium oxide layer or other passivating layer of stainless steels and other self-passivating metals.

As indicated above, the traditional method for activating stainless steels for low temperature surface hardening is by contact with a halogen containing gas. These activating techniques are essentially unaffected by this Beilby layer.

However, the same cannot be said for the self-activating technologies described in the above-noted disclosures by Somers et al. and Christiansen et al. in which the workpieces are activated by contact with acetylene or an "N/C compound." Rather, experience has shown that, if a stainless steel workpiece of complex shape is not surface treated by electropolishing, mechanical polishing, chemical etching or the like to remove its Beilby layer before surface hardening begins, the self-activating surface hardening technologies of these disclosures either do not work at all or, if they do work somewhat, produce results which at best are spotty and inconsistent from surface region to surface region.

See, Ge et al., The Effect of Surface Finish on Low-Temperature Acetylene-Based Carburization of 316L Austenitic Stainless Steel, METALLURGICAL AND MATERIALS TRANSACTIONS B, Vol. 458, December 2014, pp 2338-2345, ©2104 The Minerals, Metal & Materials Society and ASM International. As stated there, "[stainless] steel samples with inappropriate surface finishes, due for example to machining, cannot be successfully carburized by acetylene-based processes." See, in particular, FIG. 10(*a*) and the associated discussion on pages 2339 and 2343, which make clear that a "machining-induced distributed layer" (i.e., a Beilby layer) which has been intentionally introduced by etching and then scratching with a sharp blade cannot be activated and carburized with acetylene even though surrounding portions of the workpiece which have been etched but not scratched will readily activate and carburize. As a practical matter, therefore, these self-activating surface hardening technologies cannot be used on stainless steel workpieces of complex shape unless these workpieces are pretreated to remove their Beilby layers first.

To address this problem, commonly-assigned U.S. Pat. No. 10,214,805 discloses a modified process for the low temperature nitriding or carbonitriding of workpieces made from self-passivating metals in which the workpiece is contacted with the vapors produced by heating an oxygen-free nitrogen halide salt. As described there, in addition to supplying the nitrogen and optionally carbon atoms needed for nitriding and carbonitriding, these vapors also are capable of activating the workpiece surfaces for these low temperature surface hardening processes even though these surfaces may carry a Beilby layer due to a previous metal-shaping operation. As a result, this self-activating surface hardening technology can be directly used on these workpieces, even though they define complex shapes due to previous metal-shaping operations and even though they have not been pretreated to remove their Beilby layers first.

SUMMARY

In accordance with this invention, it has now been found that an additional class of compounds, namely organic compounds which (a) contain at least one carbon atom, (b) contain at least one nitrogen atom, (c) contain only carbon, nitrogen, hydrogen and optionally halide atoms, (d) are solids or liquids at room temperature (25° C.) and atmospheric pressure, and (e) have molecular weights of ≤5,000 Daltons (hereinafter "non-polymeric N/C/H compounds"), will also produce vapors capable of both supplying nitrogen and carbon atoms for low temperature carbonitriding as well as activating the surfaces of self-passivating metals for this and other low temperature surface hardening processes even though these surfaces may carry a Beilby layer due to a previous metal-shaping operation.

In particular, it has been found in accordance with this invention that low temperature surface hardening processes can be made self-activating if the source compound used to supply the nitrogen atoms for nitriding (as well as the carbon atoms for carbonitriding) is a non-polymeric N/C/H compound, even if the workpiece being surface hardened is made from a self-passivating metal carrying a Beilby layer from a previous metal shaping operation.

Thus, this invention in one embodiment provides a process for activating a workpiece for low temperature carburizing, carbonitriding or nitriding, the workpiece being made from a self-passivating metal and having one or more surface regions which include a Beilby layer as a result of a previous metal shaping operation, the process comprising contacting the workpiece with vapors produced by heating a non-polymeric N/C/H compound to a temperature which is high enough to convert the a non-polymeric N/C/H compound to vapors, the workpiece being contacted with these vapors at an activating temperature which is below a temperature at which nitride and/or carbide precipitates form.

In addition, in another embodiment this invention provides a process for simultaneously activating and carbonitriding a workpiece made from a self-passivating metal and having one or more surface regions which define a Beilby layer as a result of a previous metal shaping operation, the process comprising contacting the workpiece with vapors produced by heating a non-polymeric N/C/H compound to a temperature which is high enough to convert the a non-polymeric N/C/H compound to vapors, the workpiece being contacted with these vapors at a carbonitriding temperature which is high enough to cause nitrogen and carbon atoms to diffuse into the surfaces of the workpiece but below a temperature at which nitride precipitates or carbide precipitates form, thereby carbonitriding the workpiece without formation of nitride or carbide precipitates.

DETAILED DESCRIPTION

Definitions and Terminology

As indicated above, the fundamental difference between traditional (high temperature) surface hardening and the newer low temperature surface hardening processes first developed in the mid 1980's is that, in traditional (high temperature) surface hardening, hardening occurs as a result of the formation of carbide and/or nitride precipitates in the surfaces of the metal being hardened. In contrast, in low temperature surface hardening, hardening occurs as a result of the stress placed on the crystal lattice of the metal at the surfaces of the metal as a result of the carbon and/or nitrogen atoms which have diffused into these surfaces. Because the carbide and/or nitride precipitates responsible for surface hardening in traditional (high temperature) surface hardening are not found in stainless steels surface hardened by low temperature carburization, and further because low temperature surface hardening does not adversely affect the corrosion resistance of stainless steels, original thinking was that surface hardening occurs in low temperature carburization solely as a result of the sharply localized stress fields generated by interstitially dissolved carbon and/or nitrogen atoms which have diffused into the (austenitic) crystal structure of the steel.

However, recent more sophisticated analytical work has revealed that when low temperature surface hardening is carried out on alloys in which some or all of the alloy volume consists of ferritic phases, some type of previously-unknown nitride and/or carbide precipitate may form in small amounts in these ferritic phases. Specifically, recent analytical work suggests that in AISI 400 series stainless steels, which generally exhibit a ferrite phase structure, small amounts of previously unknown nitrides and/or carbides may precipitate when the alloy is low-temperature surface hardened. Similarly, recent analytical work suggests that in duplex stainless steels, which contain both ferrite and austenite phases, small amounts of previously unknown nitrides and/or carbides may precipitate in the ferrite phases of these steels when they are low temperature surface hardened. While the exact nature of these previously unknown, newly discovered nitride and/or carbide precipitates is still unknown, it is known that the ferrite matrix immediately surrounding these "para-equilibrium" precipitates is not depleted in its chromium content. The result is that the corrosion resistance of these stainless steels remains unimpaired, because the chromium responsible for corrosion resistance remains uniformly distributed throughout the metal.

Accordingly, for the purposes of this disclosure, it will be understood that when reference is made to a workpiece surface layer which is "essentially free of nitride and/or carbide precipitates," or to a workpiece which is surface hardened "without formation of nitride and/or carbide precipitates," or to a "temperature which is below a temperature at which nitride and/or carbide precipitates form," this reference refers to the type of nitride and/or carbide precipitates which are responsible for surface hardening in traditional (high temperature) surface hardening processes, which precipitates contain enough chromium so that the metal matrix immediately surrounding these precipitates loses its corrosion resistance as a result of being depleted in its chromium content. This reference does not refer to the previously-unknown, newly-discovered nitride and/or carbide precipitates which may form in small amounts in the ferrite phases of AISI 400 stainless steels, duplex stainless steels and other similar alloys.

Also, it should be understood that, for the purposes of this disclosure, "carbonitriding," "nitrocarburizing" and "nitrocarburization" refer to the same process.

In addition, "self-passivating" as used in this disclosure in connection with referring to the alloys which are processed by this invention will be understood to refer to the type of alloy which, upon exposure to air, rapidly forms a protective oxide coating which is impervious to the transmission of water vapor, oxygen and other chemicals. Thus, metals such as iron and low alloy steels which may form iron oxide coatings upon exposure to air are not considered to be "self-passivating" within the meaning of this term because these coatings are not impervious to the transmission of water vapor, oxygen and other chemicals.

Alloys

This invention can be carried out on any metal or metal alloy which is self-passivating in the sense of forming a coherent protective chromium-rich oxide layer upon exposure to air which is impervious to the passage of nitrogen and carbon atoms. These metals and alloys are well known and described for example in earlier patents that are directed to low temperature surface hardening processes, examples of which include U.S. Pat. Nos. 5,792,282, 6,093,303, 6,547,888, EPO 0787817 and Japanese Patent Document 9-14019 (Kokai 9-268364).

Alloys of special interest are the stainless steels, i.e., steels containing 5 to 50, preferably 10 to 40, wt. % Ni and enough chromium to form a protective layer of chromium oxide on the surface when the steel is exposed to air, typically about 10% or more. Preferred stainless steels contain 10 to 40 wt. % Ni and 10 to 35 wt. % Cr. More preferred are the AISI 300 series steels such as AISI 301, 303, 304, 309, 310, 316, 316L, 317, 317L, 321, 347, CF8M, CF3M, 254SMO, A286 and AL6XN stainless steels. The AISI 400 series stainless steels and especially Alloy 410, Alloy 416 and Alloy 440C are also of special interest.

Other types of alloys that can be processed by this invention are the nickel-based, cobalt based and manganese-based alloys which also contain enough chromium to form a coherent protective chromium oxide protective coating when the steel is exposed to air, typically about 10% or more. Examples of such nickel-based alloys include Alloy 600, Alloy 625, Alloy 825, Alloy C-22, Alloy C-276, Alloy 20 Cb and Alloy 718, to name a few. Examples of such cobalt-based alloys include MP35N and Biodur CMM. Examples of such manganese-based alloys include AISI 201, AISI 203EZ and Biodur 108.

Still another type of alloy on which this invention can be carried out are the titanium-based alloys. As well understood in metallurgy, these alloys form coherent protective titanium oxide coatings upon exposure to air which are also impervious to the passage of nitrogen and carbon atoms. Specific examples of such titanium-based alloys include Grade 2, Grade 4 and Ti 6-4 (Grade 5). In the same way, alloys based on other self-passivating metals such as zinc, copper and aluminum can also be activated (depassivated) by the technology of this invention.

The particular phase of the metal being processed in accordance with the present invention is unimportant in the sense that this invention can be practiced on metals of any phase structure including, but not limited to, austenite, ferrite, martensite, duplex metals (e.g., austenite/ferrite), etc.

Activating with a Non-Polymeric N/C/H Compound

In accordance with this invention, workpieces which are made from self-passivating metals and which carry a Beilby layer on at least one surface region thereof are activated (i.e., depassivated) for low temperature surface hardening by contacting the workpiece with the vapors produced by heating a non-polymeric N/C/H compound.

As indicated above, the non-polymeric N/C/H compounds of this invention can be described as any compound which (a) contains at least one carbon atom, (b) contains at least one nitrogen atom, (c) contains only carbon, nitrogen, hydrogen and optionally halogen atoms, (d) is solid or liquid at room temperature (25° C.) and atmospheric pressure, and (e) has a molecular weight of ≤5,000 Daltons. Non-polymeric N/C/H compounds with molecular weights of ≤2,000 Daltons. ≤1,000 Daltons or even ≤500 Daltons are more interesting. Non-polymeric N/C/H compounds which contain a total of 5-50 C+N atoms, more typically 6-30 C+N atoms, 6-25 C+N atoms, 6-20 C+N atoms, 6-15 C+N atoms, and even 6-12 C+N atoms, are even more interesting.

Specific classes of non-polymeric N/C/H compounds that can be used in this invention include primary amines, secondary amines, tertiary amines, azo compounds, heterocyclic compounds, ammonium compounds, azides and nitriles. Of these, those which contain 6-30 C+N atoms are desirable. Those which contain 6-30 C+N atoms, alternating C═N bonds and one or more primary amine groups are especially interesting. Examples include melamine, aminobenzimidazole, adenine, benzimidazole, guanidine, pyrazole, cyanamide, dicyandiamide, imidazole, 2,4-diamino-6-phenyl-1,3,5-triazine (benzoguanamine), 6-methyl-1,3,5-triazine-2,4-diamine (acetoguanamine). 3-amino-5,6-dimethyl-1,2,4-triazine, 3-amino-1,2,4-triazine, 2-(aminomethyl)pyridine, 4-(aminomethyl)pyridine, 2-amino-6-methylpyridine and 1H-1,2,3-triazolo(4,5-b) pyridine, 1,10-phenanthroline, 2,2'-bipyridyl and (2-(2-pyridyl)benzimidazole).

Also interesting are the three triazine isomers, as well as various aromatic primary amines containing 6-30 C+N atoms such as 4-methylbenzeneamine (p-toluidine), 2-methylaniline (o-toluidine), 3-methylaniline (m-toluidine), 2-aminobiphenyl, 3-aminobiphenyl, 4-aminobiphenyl, 1-naphthylamine, 2-naphthylamine, 2-aminoimidazole, and 5-aminoimidazole-4-carbonitrile. Also interesting are aromatic diamines containing 6-30 C+N atoms such as 4,4'-methylene-bis(2-methylaniline), benzidine, 4,4'-diaminodiphenylmethane, 1,5-diaminonaphthalene, 1,8-diaminonaphthalene, and 2,3-diaminonaphthalene. Hexamethylenetetramine, benzotriazole and ethylene diamine are also of interest.

Yet another interesting class of compounds, in which some of the above compounds are included, are those which form nitrogen-based chelating ligands, i.e., polydentate ligands containing two or more nitrogen atoms arranged to form separate coordinate bonds with a single central metal atom. Compounds forming bidentate chelating ligands of this type are especially interesting. Examples include o-phenantrolin, 2,2'-bipyridine, aminobenzimidazol and guanidinium chloride (guanidinium chloride being further discussed below).

Still another interesting type of non-polymeric N/C/H compound is the graphitic carbon nitrides described in WO 2016/027042, the disclosure of which is incorporated herein in its entirety. This material, which has the empirical formula $C_3N_4$, comprises stacked layers or sheets one atom thick, which layers are formed from carbon nitride in which there are three carbon atoms for every four nitrogen atoms. Solids containing as little as 3 such layers and as many as 1000 or more layers are possible. Although carbon nitrides are made with no other elements being present, doping with other elements is contemplated.

In some embodiments of the invention, the non-polymeric N/C/H compound used will contain only N, C and H atoms. In other words, the particular non-polymeric N/C/H compound used will be halogen-free. In other embodiments of the invention, however, some or all of the labile hydrogen atoms in the non-polymeric N/C/H compound can be substituted with a halogen atom, preferably Cl, F or both. In this regard, for ease of description, non-polymeric N/C/H compounds of this invention which contain one or more halogen atoms are referred to herein as "halogen-substituted," while non-polymeric N/C/H compounds of this invention which are halogen-free are referred to herein as "unsubstituted."

In those embodiments of this invention in which halogen-substituted non-polymeric N/C/H compounds are used, all of the non-polymeric N/C/H compounds used can be halogen-substituted. More commonly, however, additional amounts of unsubstituted non-polymeric N/C/H compounds will also be present. In these embodiments, the amount of halogen-substituted non-polymeric N/C/H compound used will normally be ≥1 wt. %, based on the total amount of non-polymeric N/C/H compound used, i.e., based on the combined amounts of the halogen-substituted and unsubstituted non-polymeric N/C/H compounds. More commonly, the amount of halogen-substituted non-polymeric N/C/H compound used will be ≥2 wt. %, ≥3.5 wt. %, ≥5 wt. %, ≥7.5 wt. %, ≥10 wt. %, ≥12.5 wt. %, ≥15 wt. %, or even ≥20 wt. %, on this same basis. Similarly, the amount of halogen-substituted non-polymeric N/C/H compounds used will also normally be ≤75 wt. %, more typically ≤60 wt. %, ≤50 wt. %, ≤40 wt. %, ≤30 wt. %, or even ≤25 wt. %, on this same basis.

In accordance with this invention, it has surprisingly been found that vapors produced by heating a non-polymeric N/C/H compound to vapors, in addition to supplying nitrogen and carbon atoms for surface hardening, are so potent that they readily activate the surface of self-passivating metals notwithstanding the presence of a significant Beilby layer. Even more surprisingly, it has also found that workpieces activated in this way can be surfaced hardened in much shorter periods of time than possible in the past. For example, while it may take earlier processes for activation followed by low temperature surface hardening 24-48 hours to achieve a suitable case, the inventive process for activation followed by low temperature surface hardening can achieve a comparable case in as little as two hours.

Although not wishing to be bound to any theory, it is believed that the vapors of this non-polymeric N/C/H compound decompose by pyrolysis either prior to and/or as a result of contact with the workpiece surfaces to yield ionic and/or free-radical decomposition species, which effectively activate the workpiece surfaces. In addition, this decomposition also yields nitrogen and carbon atoms which diffuse into the workpiece surfaces thereby hardening them through low temperature carbonitriding.

It will therefore be appreciated that, when a non-polymeric N/C/H compound is used for activation in accordance with this invention, activation and at least some surface hardening will occur simultaneously, which may make it is unnecessary to include additional nitrogen- and/or carbon-containing compounds in the system for augmenting the surface hardening process. This is not to say, however, that such additional compounds cannot or should not be included.

In this regard, it should be appreciated that the extent to which a workpiece is surface hardened when activated in accordance with this invention depends on a variety of different factors including the nature of the particular alloy being treated, the particular non-polymeric N/C/H compound being used, and the temperature at which activation occurs. Generally speaking, activation in accordance with this invention occurs at temperatures which are somewhat lower than the temperatures normally involved in low temperature surface hardening. In addition, different alloys can differ from one another in terms of the temperatures at which they activate and surface harden. In addition, different non-polymeric N/C/H compounds contain greater or lesser relative amounts of nitrogen and carbon atoms.

That being the case, in some embodiments of the invention a particular alloy may become fully surface hardened at the same time it is activated solely as a result of the nitrogen atoms and carbon atoms liberated from the non-polymeric N/C/H compound. If so, augmenting the surface hardening process by including an additional nitrogen- and/or carbon-containing compound or compounds in the system for supplying additional nitrogen atoms and/or carbon atoms may be unnecessary.

In other embodiments of the invention, however, a particular alloy may not become fully surface hardened solely as a result of the nitrogen atoms and carbon atoms liberated by the non-polymeric N/C/H compound during activation. If so, additional nitrogen- and/or carbon-containing compounds can be included in the system for supplying additional nitrogen atoms and/or carbon atoms for augmenting the surface hardening process. If so, these additional nitrogen- and/or carbon containing compounds can be supplied to the depassivation (activation) furnace at the same time as depassivation (activation) starts or at any time before depassivation (activation) is completed. Normally, this additional nitrogen- and/or carbon-containing compound will be different from the non-polymeric N/C/H compound used for surface hardening, but it can also be the same compound, if desired.

In addition, and/or alternatively to augmenting surface hardening during activation in this way, augmenting surface hardening can be postponed until after activation has been completed by supplying additional nitrogen- and/or carbon-containing compounds only after activation is finished. If so, augmented surface hardening can be carried out in the same reactor or a different reactor than that used for activation.

The temperatures to which the workpiece is subjected during activation in accordance with this invention should be high enough to achieve activation but not so high that nitride and/or carbide precipitates form.

In this regard, it is well understood in low temperature surface hardening processes that if the workpiece is exposed to temperatures which are too high, unwanted nitride and/or carbide precipitates form. In addition, it is also understood that the maximum surface hardening temperature a workpiece can tolerate without forming these nitride and/or carbide precipitates depends on a number variables including the particular type of low temperature surface hardening process being carried out (e.g., carburization, nitriding or carbonitriding), the particular alloy being surface hardened (e.g., nickel-based vs. iron-bases alloys) and the concentration of the diffused nitrogen and/or carbon atoms in the workpiece surfaces. See, for example, commonly-assigned U.S. Pat. No. 6,547,888. So, it is also well understood that in carrying out low temperature surface hardening processes, care must be taken to avoid surface hardening temperatures which are too high in order that formation of nitride and/or carbide precipitates is avoided.

So, in the same way, in carrying out the inventive activation process, care should also be taken to ensure that the temperature to which the workpiece is exposed during activation is not so high that unwanted nitride and/or carbide precipitates form. Generally, this means that the maximum temperature to which the workpiece is exposed during activation and simultaneous and/or subsequent surface hardening should not exceed about 500° C., preferably 475° C. or even 450° C., depending on the particular alloy being treated. So, for example, when nickel-based alloys are being activated and surface hardened, the maximum processing temperature can typically be as high as about 500° C., as these alloys generally do not form nitride and/or carbide precipitates until higher temperatures are reached. On the other hand, when iron-based alloys such as stainless steels are being activated and surface hardened, the maximum processing temperature should desirably be limited to about 475° C., preferably 450° C., as these alloys tend to become sensitive to the formation of nitride and/or carbide precipitates at higher temperatures.

In terms of minimum processing temperature, there is no real lower limit other than the fact that the temperatures of both the non-polymeric N/C/H compound and the workpiece itself must be high enough so that the workpiece becomes activated as a result of the vapors that are produced. Normally, this means the non-polymeric N/C/H compound will be heated to a temperature of ≥100° C., although more typically the non-polymeric N/C/H compound will be heated to a temperature of ≥150° C., ≥200° C., ≥250° C., or even ≥300° C. Activation temperatures of ≥350° C., ≥400° C., or even ≥450° are contemplated.

The time it takes a particular alloy to become activated for low temperature surface hardening in accordance with this invention also depends on many factors including the nature of the alloy being activated, the particular non-polymeric N/C/H compound being used and the temperature at which activation occurs. Generally speaking, activation can be accomplished in as short as 1 second to as long as 3 hours. More typically, however, most alloys will become sufficiently activated in 1 to 150 minutes, 5 to 120 minutes, 10 to 90 minutes, 20 to 75 minutes, or even 30 to 60 minutes. The period of time it takes a particular alloy to become sufficiently activated by the inventive process can be easily determined by routine experimentation on a case-by-case basis. Moreover, in those instances in which activation and surface hardening occur simultaneously, whether or not additional nitrogen and/or carbon compounds are included in the system for augmenting surface hardening, the minimum time for activation will normally be determined by the minimum time needed to complete the surface hardening process.

As for pressure, the inventive activation process can be carried out at atmospheric pressure, above atmospheric pressure or at subatmospheric pressures including a hard vacuum, i.e., at a total pressure of 1 torr (133 Pa (Pascals) or less as well as a soft vacuum, i.e., a total pressure of about 3.5 to 100 torr (~500 to ~13,000 Pa (Pascals)).

The amount of a non-polymeric N/C/H compound to use for activating a particular workpiece also depends on many factors including the nature of the alloy being activated, the surface area of the workpiece being treated and the particular a non-polymeric N/C/H compound being used. It can easily be determined by routine experimentation using the following working examples as a guide.

Finally, note that an important feature of this invention is that its non-polymeric N/C/H compound compounds are oxygen-free. The reason is to avoid generating fugitive oxygen atoms upon reaction of these compounds, which would otherwise occur if these compounds contained oxygen atoms. As indicated above, it is believed that activation occurs in accordance with this invention due to the ionic and/or free-radical decomposition species which are generated when the non-polymeric N/C/H compounds of this invention decompose. It is believed that any such fugitive oxygen atoms would react with and thereby incapacitate these ionic and/or free-radical decomposition species. Indeed, this explains why the processes described in the above-noted Christiansen et al. patent have difficulties when the workpieces being treated carry a Beilby layer, because the N/C compounds actually used there contain significant amounts of oxygen. This problem is avoided in accordance with this invention, because the non-polymeric N/C/H compound compounds being used are oxygen-free.

In some respects, the inventive activation process appears similar to the activation process described in U.S. Pat. No. 8,414,710 to Minemura et al. in which decomposition products produced by heating certain amino resins are used to "depassivate" certain iron-based alloys. However, the iron-based alloys described there are not truly "self-passivating" as that term is understood in the art. This is because the amount of chromium they contain, 5 wt. % or less, is too small for the alloy to form the protective chromium oxide coatings that makes iron-based alloys corrosion resistant, typically 10 wt. % or more. Moreover, the patent itself makes clear that the "passive" films it is referring to are composed of iron oxide, i.e., rust, which is known not to be impervious to the transmission of water vapor, oxygen and other chemicals.

Moreover, the amino resin activating compounds used in Minemura et al. are polycondensation polymers having high molecular weights. Generally speaking, these materials do not pyrolyze at the low temperatures required by the inventive activation process, which are necessary to avoid formation of nitride and/or carbide precipitates. Indeed, the lowest activation temperature described in this reference is 600° C., which is significantly above the temperatures at which nitride and/or carbide precipitates begin to form, typically 500° C. or so.

Accordingly, Minemura et al. has no real relevance to this invention, not only because the alloys it describes are not "self-passivating" as that term is understood in the art but also because the temperatures needed to cause its amino resin activating compounds to pyrolyze would also cause nitride and/or carbide precipitates to form.

Low Temperature Thermal Hardening

As indicated above, in addition to activating the surfaces of self-passivating metals for low temperature nitriding or carbonitriding, the vapors produced by heating a non-polymeric N/C/H compound of this invention also supply nitrogen and carbon atoms that will achieve at least some thermal hardening of the workpiece by means of these thermal hardening processes, even if no additional reagents are included in the reaction system.

However, if desired, the speed with which low temperature thermal hardening occurs can be increased by including additional nitrogen and/or carbon-containing reagents in the reaction system—in particular, by contacting the workpiece with additional nitrogen containing compounds which are capable of decomposing to yield nitrogen atoms for nitriding, additional carbon-containing compounds which are capable of decomposing to yield carbon atoms for carburization, additional compounds containing both carbon and nitrogen atoms which are capable of decomposing to yield both carbon atoms and nitrogen atoms for carbonitriding, or any combination of these.

These additional nitrogen- and/or carbon-containing compounds can be added to the reaction system any time. For example, they can be added after activation of the workpiece has been completed, or at the same time activation is occurring. Finally, they can also be added before activation begins, although it is believed low temperature surface hardening will be more effective if they are added simultaneously with and/or subsequent to activation.

Generally speaking, the temperatures at which self-passivating alloys will activate (depassivate), at least when halogen containing gases are used, are normally somewhat less than the temperatures used for the subsequent low temperature surface hardening of these alloys. For example, activating AISI 316 stainless steel with HCl gas is typically carried out at about 300-350° C., whereas low temperature carburization of this alloy is typically carried out at about 425-450° C. The same relationship applies to the inventive activation process in that the temperature at which a particular alloy will activate as a result of this process will generally be less than the temperatures that would normally be used to surface harden that alloy by low temperature nitriding, carbonitriding or carburization.

For this reason, it may be desirable when carrying out combined activation and augmented surface hardening processes in accordance with this invention to select a reaction temperature which is midway between the temperatures which are optimal for each in order that the combined processes as a whole can be optimized. This can easily be done by routine experimentation, it being understood that care should be taken to avoid temperatures which are so high that unwanted nitride and/or carbide precipitates form, as indicated above.

In a particularly interesting approach, activation and thermal hardening are accomplished in accordance with this invention in a closed system as described for example in commonly-assigned U.S. Pat. No. 10,214,805, i.e., in a reaction vessel which is completely sealed against the entry or exit of any material during the entire course of the activation and thermal hardening process. To ensure that activation and thermal hardening are done properly, it is desirable that a sufficient amount of the vapors of a non-polymeric N/C/H compound contact the surfaces of the workpiece, especially those surface regions which carry significant Beilby layers. Because the non-polymeric N/C/H compound that is used for both activation and thermal hardening in accordance with this invention will often be a particulate solid, an easy way to insure this contact is done properly is by coating or otherwise covering these surfaces with this particulate solid and then sealing the reaction vessel before heating of the workpiece and a non-polymeric N/C/H compound begins. The non-polymeric N/C/H compound can also be dissolved or dispersed in a suitable liquid and then coated onto the workpiece in this fashion.

These approaches are especially convenient when large batches containing many small workpieces such as ferrules and fitting for conduits and the like are thermally hardened at the same time in the same reaction vessel.

The approach of this invention in which activation and thermal hardening are carried out in a closed system as described above resembles in some respects the technology disclosed in U.S. Pat. No. 3,232,797 to Bessen in which thin steel strip is coated with guanidinium compounds including guanidinium chloride and then heated to decompose the guanidinium compound and nitride the steel strip. However, the thin steel strip being nitrided there is not self-passivating in the sense of forming a strongly-adherent, coherent protective oxide coating which is impervious to the passage of nitrogen and carbon atoms. Accordingly, the technology described there has little relevance to this invention in which stainless steel and other self-passivating metals which are impervious to the passage of nitrogen and carbon atoms are rendered transparent to these atoms by contact with the vapors of a non-polymeric N/C/H compound as part of a low temperature thermal hardening process.

Optional Co-Activating Compound—Oxygen-Free Nitrogen Halide Salts

In accordance with another feature of this invention, it has been found that the speed at which both activation and simultaneous nitriding or carbonitriding occurs can be significantly enhanced by including in the reaction system one or more oxygen-free nitrogen halide salts, as described in the above-mentioned commonly-assigned U.S. Pat. No. 10,214,805. And, by "including in the reaction system," we mean that the oxygen-free nitrogen halide salt is also vaporized by heat so that the vapors so-produced also contact the surfaces of the workpiece being activated.

As described in U.S. Pat. No. 10,214,805, these salts can generally be described as comprising any compound which (1) includes a halide anion that provides the oxygen-free nitrogen halide salt with a room temperatures solubility in water of at least 5 moles/liter, (2) contains at least one nitrogen atom, (3) contains no oxygen, and (4) vaporizes when heated to a temperature of 350° C. at atmospheric pressure.

Specific examples of such salts include ammonium chloride, ammonium fluoride, guanidinium chloride, guanidinium fluoride, pyridinium chloride, pyridinium fluoride, benzyl triethylammonium chloride, methyl ammonium chloride, allylamine hydrochloride, p-toluidine hydrochloride, benzylamine hydrochloride, benzenetetramine, tetrahydrochloride, methyl pyrazole diamine dihydrochloride, butenylamine hydrochloride, benzidine dihydrochloride, benzene triamine dihydrochloride, imidazole hydrochloride, 2-(aminomethyl)benzimidazole dihydrochloride, 1,1-dimethylbiguanide hydrochloride, 2-guanidine-4-methylquinazoline hydrochloride, 1,3-diaminopropane dihydrochloride and any of their isomers. Mixtures of these compounds can also be used.

The amount of this oxygen-free nitrogen halide salt included in the reaction system can vary widely and essentially any amount can be used. For example, the amount of oxygen-free nitrogen halide salt can vary between 0.5 wt. % to 99.5 wt. %, based on the combined weights of this oxygen-free nitrogen halide salt and the non-polymeric N/C/H compound of this invention. Concentrations of this oxygen-free nitrogen halide salt on the order of 0.1 to 50 wt. %, more typically, 0.5 to 25 wt. %, 1 to 10 wt. %, or even 2 to 5 wt. %, are more common.

Optional Co-Activating Compound—N/C Compounds

As indicated above, WO 2011/009463 (U.S. Pat. No. 8,845,823) to Christiansen et al. teaches that stainless steels and other self-passivating metals can be depassivated by exposing the metal to the vapors generated by pyrolyzing an "N/C compound." Although this patent broadly suggests that any compound containing a nitrogen/carbon bond can be used for this purpose, the only specific compounds fairly described contain oxygen. Moreover, no appreciation is shown for the need to remove any Beilby layer that might be present on the workpieces surfaces before activation begins.

In any event, in accordance with an optional feature of this invention, the activation procedure of this invention can also be augmented by including one or more of these oxygen-containing N/C compounds in the reaction system during the activation process, if desired. If so, the amount of this optional N/C compound used will typically be ≤50 wt. %, based on the combined weights of all nitrogen-containing compounds in the system which participate in the activation process—i.e., the non-polymeric N/C/H compounds of this invention as well as the optional N/C compounds discussed here as well as the optional oxygen-free nitrogen halide salts discussed immediately above. This is because, as indicated above, the presence of oxygen can retard the activating effect of the active species produced when the non-polymeric N/C/H compounds of this invention are heated to decomposition. More typically, the amount of this optional N/C compound used will be ≤40 wt. %, ≤30 wt. %, ≤25 wt. %, ≤20 wt. %, ≤15 wt. %, ≤10 wt. %, ≤5 wt. %, ≤2 wt. %, ≤1 wt. %, ≤0.5 wt. %, or even ≤0.1 wt. %, on this same basis.

Tracers

In accordance with yet another feature of this invention, the treating reagents used in this invention—the non-polymeric N/C/H compounds—can be enriched with specific, uncommon isotopes of C, N, H and/or other elements to serve as tracer compounds for diagnostic purposes. For example, a non-polymeric N/C/H compound could be seeded with the same or a different non-polymeric N/C/H compound made with an uncommon isotope of N, C or H, or a completely different compound made with such an uncommon isotope, in low concentration. By using mass spectroscopy or other suitable analytical technique for sensing these tracers, quality control of the low temperature surface hardening processes of this invention on a production scale can be readily determined.

For this purpose, the treating reagent can be enriched with at least one of the following halide isotopes: Ammonium-(15N) Chloride, Ammonium-(15N,D4) Chloride, Ammonium-(D4) Chloride, Guanidine-(13C) Hydrochloride, Guanidine-(15N3) Hydrochloride, Guanidine-(13C, 15N3) Hydrochloride, Guanidine-(D5) Deuteriochloride, and any of their isomers. Alternatively or additionally, the treating reagent can be enriched with at least one of the following non-halide isotopes: Adenine-($^{15}N_2$), p-Toluidine-(phenyl-$^{13}C_6$), Melamine-($^{13}C_3$), Melamine-(Triamine-$^{15}N_3$), Hexamethylenetetramine-(13C6, 15N4), Benzidine-(rings-D8), Triazine(D3), and Melamine-($D_6$), and any of their isomers.

Optional Companion Gases

In addition to the gases mentioned above, the gaseous atmosphere in which activation is accomplished in accordance with this invention can also include one or more other companion gases—i.e., gases which are different from the gaseous compounds mentioned above. For example, this gaseous atmosphere can include inert gases such as argon as shown in the following working examples. In addition, other gases that do not adversely affect the invention activation process in any significant way can also be included, examples of which include hydrogen, nitrogen and unsaturated hydrocarbons such as acetylene and ethylene, for example.

Exposing the Workpiece to Atmospheric Oxygen

In still another embodiment of this invention, the workpiece is exposed to atmospheric oxygen between activation and surface hardening, i.e., after activation of the workpiece has been substantially completed but before low temperature surface hardening has been substantially completed.

As previously indicated, the traditional way in which stainless steel and other self-passivating metals are activated for low temperature carburization and/or carbonitriding is by contacting the workpiece with a halogen containing gas. In this regard, in some of the early work in this area as described in the afore-mentioned U.S. Pat. Nos. 5,556,483, 5,593,510 and 5,792,282, the halogen containing gases used for activation were restricted to fluorine-containing gases which are very corrosive and expensive. This is because when other halogen containing gases were used, especially chlorine-containing gases, the workpiece repassivated as soon as it was exposed to atmospheric oxygen between activation and thermal hardening. In this early work, therefore, only those activated workpieces which contained significant amounts of fluorine atoms could be exposed to the atmosphere without immediately repassivating.

In accordance with another feature of this invention, this trade-off between the undesirable corrosion and expense associated with using fluorine-based activators and the undesirable need to avoid repassivation when chlorine-based activators are used has been broken, since it has been found that the activated workpieces produced by this invention do not readily repassivate when exposed to atmospheric oxygen for 24 hours or longer, even though they are free of fluorine atoms.

WORKING EXAMPLES

In order to more thoroughly describe this invention, the following working examples are provided.

Example 1

A machined workpiece made from A1-6XN alloy, which is a super-austenitic stainless steel characterized by an elevated nickel content, was placed in a laboratory reactor along with powdered 2-aminobenzimidazole as an activating compound arranged to directly contact the workpiece. The reactor was purged with dry Ar gas and then heated to and held at 327° C. for 60 minutes, after which the reactor was heated to and held at 452° C. for 120 minutes.

After removal from the reactor and cooling to room temperature, the workpiece was examined and found to have a conformational and uniform case (i.e., surface coating) exhibiting a near surface hardness of 630 HV.

Example 2

Example 1 was repeated, except that the activating compound was composed of a mixture of guanidine hydrochloride and 2-aminobenzimidazole in a mass ratio of 0.01 to 0.99. In other words, the amount of guanidine hydrochloride used was 1 wt. %, based on the total amount of non-polymeric N/C/H compounds used. In addition, the reactor was heated to and held at 452° C. for 360 minutes instead of 120 minutes.

The work piece was found to exhibit a near surface hardness of 660 HV.

Example 3

Example 2 was repeated, except that the workpiece was made from AISI 316 stainless steel and the activating compound was composed of a mixture of guanidine hydrochloride and 2-aminobenzimidazole. In a first run, the mass ratio of guanidine hydrochloride to 2-aminobenzimidazole was 0.01 to 0.99 (1 wt. % guanidine hydrochloride based on the total amount of non-polymeric N/C/H compounds used), while in a second run this mass ratio was 0.10 to 0.90 (10 wt. % guanidine hydrochloride based on the total amount of non-polymeric N/C/H compounds used).

The work piece produced in the first run exhibited a near surface hardness of 550 HV, while the work piece produced in the second run exhibited a near surface hardness of 1000 HV. In addition, the case-hardened surface of the workpiece produced in the second run exhibited a superior case depth and complete conformality over its entire surface as compared with the case-hardened surface of the workpiece produced in the first run.

Example 4

Example 3 was repeated except that the activating compound used was a mixture of guanidine hydrochloride and 2-aminobenzimidazole in a mass ratio of 0.50 to 0.50 (50 wt. % guanidine hydrochloride based on the total amount of non-polymeric N/C/H compounds used).

The hardened surface or "case" of the workpiece obtained exhibited a near surface hardness of 900 HV, with mostly complete conformality over its entire surface, but with some pitting.

Although only a few embodiments of this invention have been described above, it should be appreciated that many modifications can be made without departing from the spirit and scope of this invention. All such modifications are intended to be included within the spirit and scope of this invention, which is to be limited only by the following claims:

The invention claimed is:

1. A process for treating a metal workpiece made from a self-passivating metal and having one or more surface regions comprising a Beilby layer, the process comprising:

heating a non-polymeric, halogen-free N/C/H compound to a processing temperature below a temperature at which nitride and/or carbide precipitates form to produce vapors, wherein the non-polymeric, halogen-free N/C/H compound:

(a) comprises at least one of melamine; aminobenzimidazole; adenine; benzimidazole; guanidine; cyanamide; dicyandiamide; 2,4-diamino-6-phenyl-1,3,5-triazine; 6-methyl-1,3,5-triazine-2,4-diamine; 2-(aminomethyl)pyridine; 4-(aminomethyl)pyridine; 2-amino-6-methylpyridine; 1,10-phenanthroline; 2,2'-bipyridine; (2-(pyridyl)benzimidazole); 4-methylbenzeneamine; 2- methylaniline; 3-methylaniline; 2-aminobiphenyl; 3-aminobiphenyl; 4-aminobiphenyl; 1-naphthylamine; 2-naphthylamine; 2-aminoimidazole; 5-aminoimidazole-4-carbonitrile; 4,4'-methylene-bis(2-methylaniline); benzidine; 4,4'-diaminodiphenylmethane; 1,5-diaminonaphthalene; 1,8-diaminonaphthalene; 2,3-diaminonaphthalene; hexamethylenetetramine; and ethylene diamine, (b) is solid or liquid at 25° C. and atmospheric pressure, and (c) has a molecular weight of ≤5,000 Daltons, and exposing the workpiece to the vapors.

2. The process of claim 1, wherein the processing temperature is ≤500° C.

3. The process of claim 2, wherein the processing temperature is ≤475° C.

4. The process of claim 2, wherein the non-polymeric N/C/H compound has a molecular weight of ≤500 Daltons.

5. The process of claim 2, wherein at least one of:

the non-polymeric N/C/H compound contains 5-50 C+N atoms;

the non-polymeric N/C/H compound contains 6-30 C+N atoms, alternating C=N bonds and one or more primary amine groups; and the non-polymeric N/C/H compound is an aromatic amine containing 6-30 C+N atoms.

6. The process of claim 2, wherein the non-polymeric N/C/H compound is unsubstituted in the sense of containing only C, N and H atoms.

7. The process of claim 1, wherein the self-passivating metal comprises at least one of:

a titanium-based alloy, and an alloy containing at least 10 wt. % Cr and at least one of iron, nickel, cobalt, and manganese.

8. The process of clam 7, wherein the self-passivating metal is a titanium-based alloy.

9. The process of clam 7, wherein the self-passivating metal is the alloy containing at least 10 wt. % Cr and at least one of iron, nickel, cobalt, and manganese.

10. The process of claim 1, wherein the self-passivating metal is a stainless steel containing 10 to 40 wt. % Ni and 10 to 35 wt. % Cr.

11. The process of claim 7, further comprising:

subjecting the workpiece to at least one of:

low temperature carburizing, low temperature nitriding, and low temperature carbonitriding to form a hardened surface layer on a workpiece surface without nitride or carbide precipitates by contacting the workpiece with a gas different from said vapors, said gas containing at least one of:

a compound capable of decomposing to yield nitrogen atoms for nitriding, a compound capable of decomposing to yield carbon atoms for carburizing, and a compound capable of decomposing to yield both nitrogen atoms and carbon atoms for carbonitriding.

12. The process of claim 11, wherein the workpiece is contacted with the additional gas only after the workpiece has been exposed to the non-polymeric, halogen-free N/C/H compound.

13. The process of claim 11, further comprising exposing the workpiece to oxygen after the workpiece has been exposed to the non-polymeric, halogen-free N/C/H compound, and further wherein said workpiece is free of fluorine atoms.

14. The process of claim 13, wherein:

exposing the workpiece to the non-polymeric, halogen-free N/C/H compound is carried out in a depassivation furnace, low temperature carburizing, nitriding, and/or carbonitriding is accomplished in a thermal processing furnace, and the workpiece is exposed to oxygen while being transferred between the depassivation furnace and the thermal processing furnace.

15. A process for treating a workpiece, wherein:

the workpiece:

is a corrosion-resistant, self-passivating metal comprising at least one of (i) a stainless steel containing 5-50 wt. % Ni and at least 10 wt. % Cr, and (ii) an alloy containing at least 10 wt. % Cr and at least one of iron, nickel, cobalt, and manganese, and a titanium-based alloy;

has one or more surface regions with a Beilby layer, has a protective coating of at least one of chromium oxide or titanium oxide; and the process comprises:

heating a non-polymeric, halogen-free N/C/H compound to a processing temperature high enough to convert the non-polymeric, halogen-free N/C/H compound to vapors, less than 500° C., and below a temperature at which nitride and/or carbide precipitates form, wherein the non-polymeric, halogen-free N/C/H compound:

(a) comprises at least one of melamine; aminobenzimidazole; adenine; benzimidazole; guanidine; cyanamide; dicyandiamide; 2,4-diamino-6-phenyl-1,3,5-triazine; 6-methyl-1,3,5-triazine-2,4-diamine; 2-(aminomethyl)pyridine; 4-(aminomethyl)pyridine; 2-amino-6-methylpyridine; 1,10-phenanthroline; 2,2'-bipyridine; (2-(pyridyl)benzimidazole); 4-methylbenzeneamine; 2- methylaniline; 3-methylaniline; 2-aminobiphenyl; 3-aminobiphenyl; 4-aminobiphenyl; 1-naphthylamine; 2-naphthylamine; 2-aminoimidazole; 5-aminoimidazole-4-carbonitrile; 4,4'-methylene-bis(2-methylaniline); benzidine; 4,4'-diaminodiphenylmethane; 1,5-diaminonaphthalene; 1,8-diaminonaphthalene; 2,3-diaminonaphthalene; hexamethylenetetramine; and ethylene diamine, (b) is solid or liquid at 25° C. and atmospheric pressure, and (c) has a molecular weight of ≤5,000 Daltons, contacting the workpiece with the vapors to:

depassivate the workpiece; and simultaneously surface harden the workpiece by causing at least one of carbon and nitrogen atoms to diffuse into the surface of the workpiece without formation of carbide and nitride precipitates.

* * * * *